US011225308B2

(12) United States Patent
Sorigue et al.

(10) Patent No.: US 11,225,308 B2
(45) Date of Patent: Jan. 18, 2022

(54) DIVING MASK HAVING A BODY PROVIDED WITH AN EXHALED AIR EXHAUST DEVICE INCLUDING A CHECK VALVE

(71) Applicant: DECATHLON, Villeneuve d'Ascq (FR)

(72) Inventors: Quentin Sorigue, Hendaye (FR); Jonathan Vandamme, Wervicq-Sud (FR)

( * ) Notice: Subject to any disclaimer, the term of this patent is extended or adjusted under 35 U.S.C. 154(b) by 166 days.

(21) Appl. No.: 16/500,134

(22) PCT Filed: Mar. 30, 2018

(86) PCT No.: PCT/FR2018/050815
§ 371 (c)(1),
(2) Date: Oct. 2, 2019

(87) PCT Pub. No.: WO2018/185416
PCT Pub. Date: Oct. 11, 2018

(65) Prior Publication Data

US 2021/0129958 A1 May 6, 2021

(30) Foreign Application Priority Data

Apr. 3, 2017 (FR) ..... 17 52871

(51) Int. Cl.
*B63C 11/16* (2006.01)
*B63C 11/12* (2006.01)

(52) U.S. Cl.
CPC ..... *B63C 11/16* (2013.01); *B63C 2011/128* (2013.01); *B63C 2011/165* (2013.01)

(58) Field of Classification Search
CPC .... B63C 11/16; B63C 11/12; B63C 2011/165
USPC ..... 405/186
See application file for complete search history.

(56) References Cited

U.S. PATENT DOCUMENTS

| | | | | |
|---|---|---|---|---|
| 6,668,823 | B1 | 12/2003 | Liu | |
| 2016/0297505 | A1 | 10/2016 | Caprice et al. | |
| 2017/0096204 | A1* | 4/2017 | Cucchia | B63C 11/16 |
| 2018/0065719 | A1* | 3/2018 | Liao | B63C 11/16 |
| 2019/0224506 | A1* | 7/2019 | Palmieri | F16K 15/144 |

FOREIGN PATENT DOCUMENTS

| | | | |
|---|---|---|---|
| FR | 2720050 | A1 | 11/1995 |
| FR | 3020620 | A1 | 11/2015 |

OTHER PUBLICATIONS

English language abstract of FR 2720050.

* cited by examiner

*Primary Examiner* — Frederick L Lagman
(74) *Attorney, Agent, or Firm* — Yasser Mourtada; Robert Facey

(57) ABSTRACT

The disclosure relates to a diving mask comprising a body having a faceplate and a flexible skirt, and a snorkel extending a top portion of the body. The body includes an exhaled air exhaust device that puts the bottom chamber in fluid-flow connection with the air duct of the snorkel. The exhaled air exhaust includes at least a first check valve arranged to allow exhaled air from the bottom chamber to flow towards the air duct of the snorkel during a stage in which the user is breathing out, the first check valve being closed during a stage in which the user is breathing in.

21 Claims, 11 Drawing Sheets

DIVING MASK HAVING A BODY PROVIDED WITH AN EXHALED AIR EXHAUST DEVICE INCLUDING A CHECK VALVE

BACKGROUND

The present disclosure relates to the field of diving masks, and in particular masks used for underwater "snorkeling".

This underwater snorkeling activity allows the sea bottom to be observed while swimming at the surface of the water. The snorkeler must thus be able to keep the head underwater while breathing.

Generally, the snorkeler is equipped with a mask for viewing and a snorkel for breathing. The snorkel is constituted by a tube having a bottom end that is provided with a mouthpiece that is received in the user's mouth, and a top end that serves both to admit fresh air and to exhaust exhaled air.

Such equipment is known to present numerous drawbacks. Firstly, breathing through the mouth is not natural and some people have difficulty breathing properly with a snorkel. Another drawback is that it is not possible to speak underwater with a snorkel in the mouth.

Furthermore, the use of such masks and snorkel apparatus is not very comfortable. In order to remedy that drawback, Document FR 3 020 620 proposes a diving mask making it possible to breathe through the nose and through the mouth.

That diving mask comprises:

a body having a faceplate and a flexible skirt, said flexible skirt including a partition separating a top chamber for vision from a bottom chamber for breathing, the partition being arranged to bear on the user's nose so that the user's mouth and nose are situated in the bottom chamber while the user's eyes are situated in the top chamber, the partition including at least one passage arranged to allow fresh air to flow between the top chamber and the bottom chamber during a stage in which the user is breathing in; and a snorkel arranged to extend a top portion of the body, the snorkel including at least one air duct;

wherein the body includes an exhaled air exhaust device putting the bottom chamber into fluid-flow connection with the air duct of the snorkel.

That mask also includes a snorkel having a plurality of channels and a plate that includes check valves in order to close the air outlet channels while breathing in and in order to close the air inlet channel while breaking out.

Although such a snorkel provides satisfaction in use, such a snorkel is relatively complex and expensive to fabricate.

SUMMARY

A first object of the disclosure is to propose a mask of simpler design remedying the above-mentioned drawbacks.

The disclosure achieves this object by the fact that the exhaled air exhaust includes at least a first check valve arranged to allow exhaled air from the bottom chamber to flow towards the air duct of the snorkel during a stage in which the user is breathing out, the first check valve being closed during a stage in which the user is breathing in.

It can be understood firstly that the snorkel is in fluid-flow connection with the top chamber. For this purpose, the body advantageously has a fresh air entry device that is in fluid-flow communication with the snorkel and with the top chamber.

Furthermore, the first check valve is situated on the body of the mask, whereas, in the above-mentioned prior art, the check valve is situated on a plate of the snorkel.

In the disclosure, the first check valve is arranged to close the exhaled air exhaust device during a stage of breathing in.

Furthermore, the flexible skirt is preferably fastened to the faceplate. Furthermore, at least part of the faceplate is preferably transparent. Preferably, the faceplate presents a transparent plane portion that is situated facing the top chamber.

Thus, during a stage of breathing in, the first check valve closing has the effect of preventing fresh air from flowing via the air exhaust device. One advantage is to avoid breathing in the air that has been breathed out and that is still to be found in the exhaled air exhaust device or in the air duct of the snorkel.

Such an arrangement makes it possible to simplify the design and the fabrication of the snorkel, given that the first check valve is in the body of the mask.

Operation is as follows.

During a stage in which the user is breathing out, the first check valve opens and the air breathed out can flow in the air duct of the snorkel via the exhaled air exhaust device.

During a stage of breathing in, the first check valve closes and fresh air enters into the snorkel and then flows successively in the top chamber and in the bottom chamber where the user's mouth and nose are to be found. Since the first check valve is closed, the user does not breathe in the air breathed out during the previous breathing cycle.

Advantageously, the first check valve is arranged between the bottom chamber and the exhaled air exhaust device. Thus, the first check valve is arranged close to the user's mouth and nose, thereby making it easier to open while breathing out. It can be understood that the first check valve opens because of the increase in pressure in the bottom chamber while breathing out.

The first check valve may equally well be arranged in the bottom chamber.

Advantageously, the first check valve is arranged in the exhaled air exhaust device. Preferably, the first check valve is situated in a bottom end portion of the exhaled air exhaust device, in order to be situated in the proximity of the bottom chamber.

Advantageously, the first check valve includes a flexible membrane.

In very preferred manner, the flexible membrane is constituted by a portion of the flexible skirt. One advantage is to limit the number of parts constituting the mask, thereby serving to reduce its cost of fabrication.

Nevertheless, without going beyond the ambit of the present disclosure, the flexible membrane could equally well be a separate fitting, distinct from the skirt.

Advantageously, the first check valve includes a valve seat co-operating with the flexible membrane, the valve seat being integral with the faceplate.

Once more, an advantage is to limit the number of parts constituting the mask, thereby enabling the cost of fabricating the mask to be further reduced.

Preferably, the valve seat is made integrally with the faceplate. Advantageously, the valve seat constitutes a portion of the faceplate.

In an advantageous but non-exclusive embodiment, the exhaled air exhaust device includes at least a first exhaled air exhaust channel extending along one of the side edges of the faceplate, the flexible snorkel having a first side portion that covers the first exhaled air exhaust channel.

The first air exhaust channel may be constituted by two adjacent flanges that project from an edge of the faceplate.

The side portion of the skirt includes a side edge in which the first exhaust channel is engaged in order to prevent water from penetrating into the first exhaust channel. For this purpose, the side edge of the skirt has a top wall and two side walls; the side walls encompass the two flanges of the first exhaust channel, while the top wall covers the first exhaust channel in order to seal it. Furthermore, the side edge is situated at the outer periphery of the sealing lip of the skirt, which is arranged to press against the face of the user.

Preferably, the first exhaled air exhaust channel is integral with the faceplate. Also preferably, the two adjacent flanges are formed integrally with the faceplate.

Also preferably, the valve seat of the first check valve is constituted by a portion of the first exhaled air exhaust channel.

Preferably, the body of the mask further includes a band surrounding the faceplate. Preferably, the peripheral edge of the skirt is clamped between the band and first exhaust channel. This has the effect of preventing the peripheral edge of the skirt from becoming uncoupled from the first exhaust channel.

Advantageously, the first exhaled air exhaust channel includes a bottom end portion having at least one opening opening out into the bottom chamber, and the first check valve is arranged to close said opening during a stage in which the user is breathing in.

Preferably, the flexible membrane is situated inside the first exhaled air exhaust channel, in register with said opening. Furthermore, the opening is arranged between portions of the first exhaled air exhaust channel that constitute the seat of the first check valve.

Preferably, the bottom end portion has two adjacent openings that are closable by the membrane of the first check valve. In another variant, the first check valve could have a plurality of flexible membranes.

Advantageously, the exhaled air exhaust device further includes a second exhaled air exhaust channel, and a second check valve arranged to allow exhaled air from the bottom chamber to flow towards the air duct of the snorkel during a stage in which the user is breathing out, the second check valve being closed during a stage in which the user is breathing in.

The second exhaled air exhaust channel is similar to the first exhaled air exhaust channel. Furthermore, the first and second exhaled air exhaust channels are situated on either side of the body of the mask.

In another advantageous aspect of the disclosure, the snorkel includes a single air duct that is in fluid-flow communication with the bottom chamber and with the top chamber.

An advantage is thus to make the snorkel simpler to design and to fabricate, in comparison with the above-mentioned prior art snorkel, which has three channels. Another advantage is to be able to have the entire inside volume of the snorkel available both for breathing in and for breathing out, unlike the prior art in which the snorkel is subdivided into air-inlet and air-outlet channels. This makes it possible significantly to increase the rate at which incoming and outgoing air can flow compared with the prior art mask, thereby making the mask more comfortable to use and facilitating breathing through the mouth and the nose.

The single air duct is thus in fluid-flow communication with the exhaled air exhaust device and also with the fresh air inlet device. Also preferably, the single air duct is in fluid-flow communication with the first and second exhaled air exhaust channels.

Advantageously, the partition includes at least one check valve arranged to allow fresh air from the top chamber to flow towards the bottom chamber only during a stage of the user breathing in.

It can be understood that the check valve then opens during a stage of breathing in and closes during a stage of breathing out. The function of the check valve is to prevent exhaled air from flowing towards the top chamber, thereby avoiding mist appearing on the plane portion of the faceplate situated in front of the user's eyes.

In another advantageous aspect of the disclosure, the check valve includes a flexible flap constituted by a portion of the flexible skirt. Preferably, the flexible flap of the check valve is constituted by a portion of the partition. The flexible flap is preferably defined between a free edge of the partition and a cutout made in the partition. By means of this cutout, the flexible flap is movable, allowing it to fold during a stage of breathing in so as to open said passage.

Also preferably, during a stage of breathing out, the flexible flap of the check valve comes to bear against the faceplate so as to close said passage.

During a stage of breathing in, the flexible flap of the check valve opens so as to allow fresh air to enter into the bottom chamber.

Advantageously, the flexible skirt has a top sleeve that surrounds the top connector of the faceplate. An advantage is to provide sealing between the skirt and the connector in the top portion of the body of the mask.

BRIEF DESCRIPTION OF THE DRAWINGS

The disclosure can be better understood on reading the following description of an embodiment of the disclosure given by way of non-limiting example, and with reference to the accompanying drawings, in which.

DETAILED DESCRIPTION

Figure 1A:
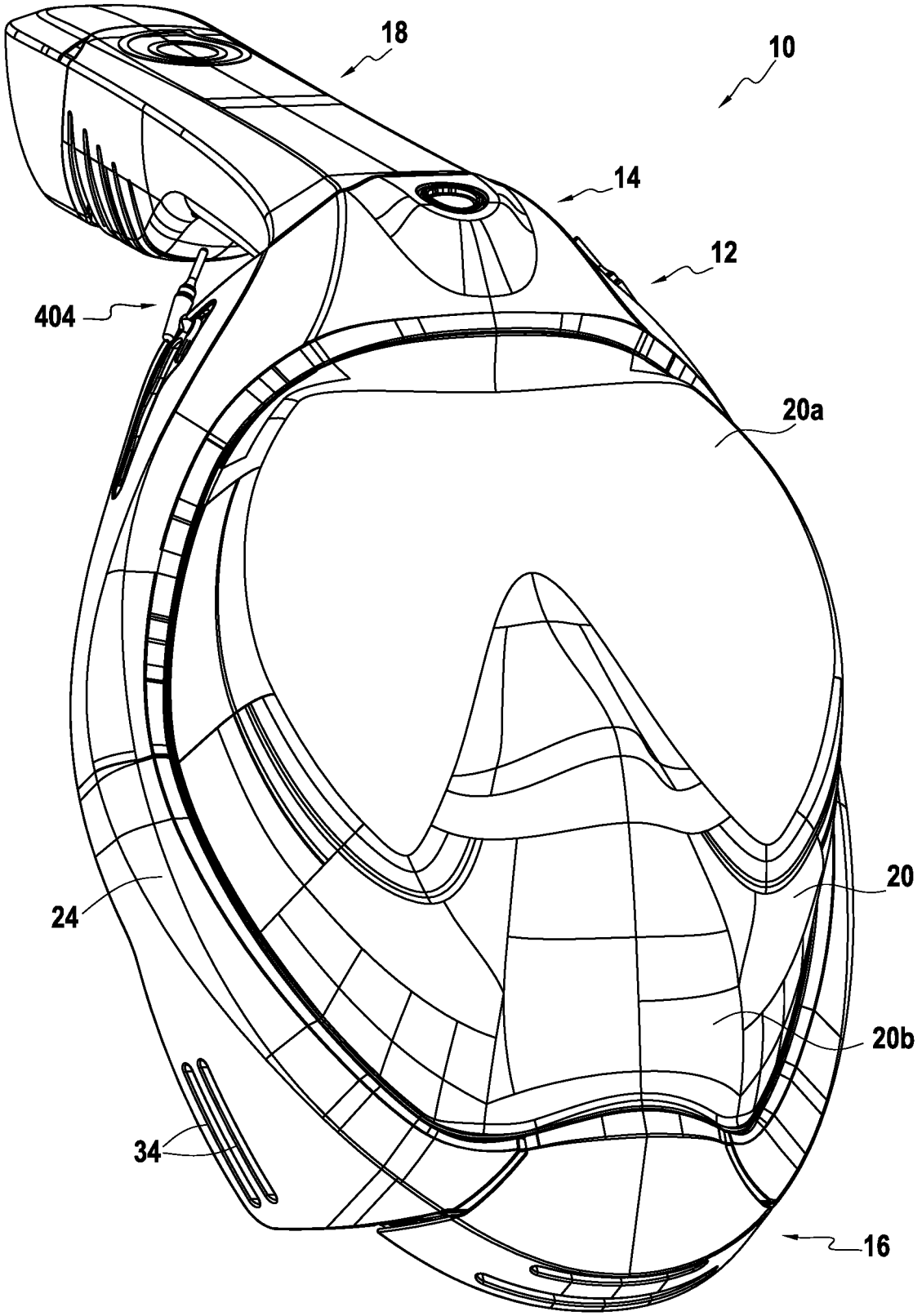
FIG. 1A is a front view of the mask of the disclosure.
Figure 1B:
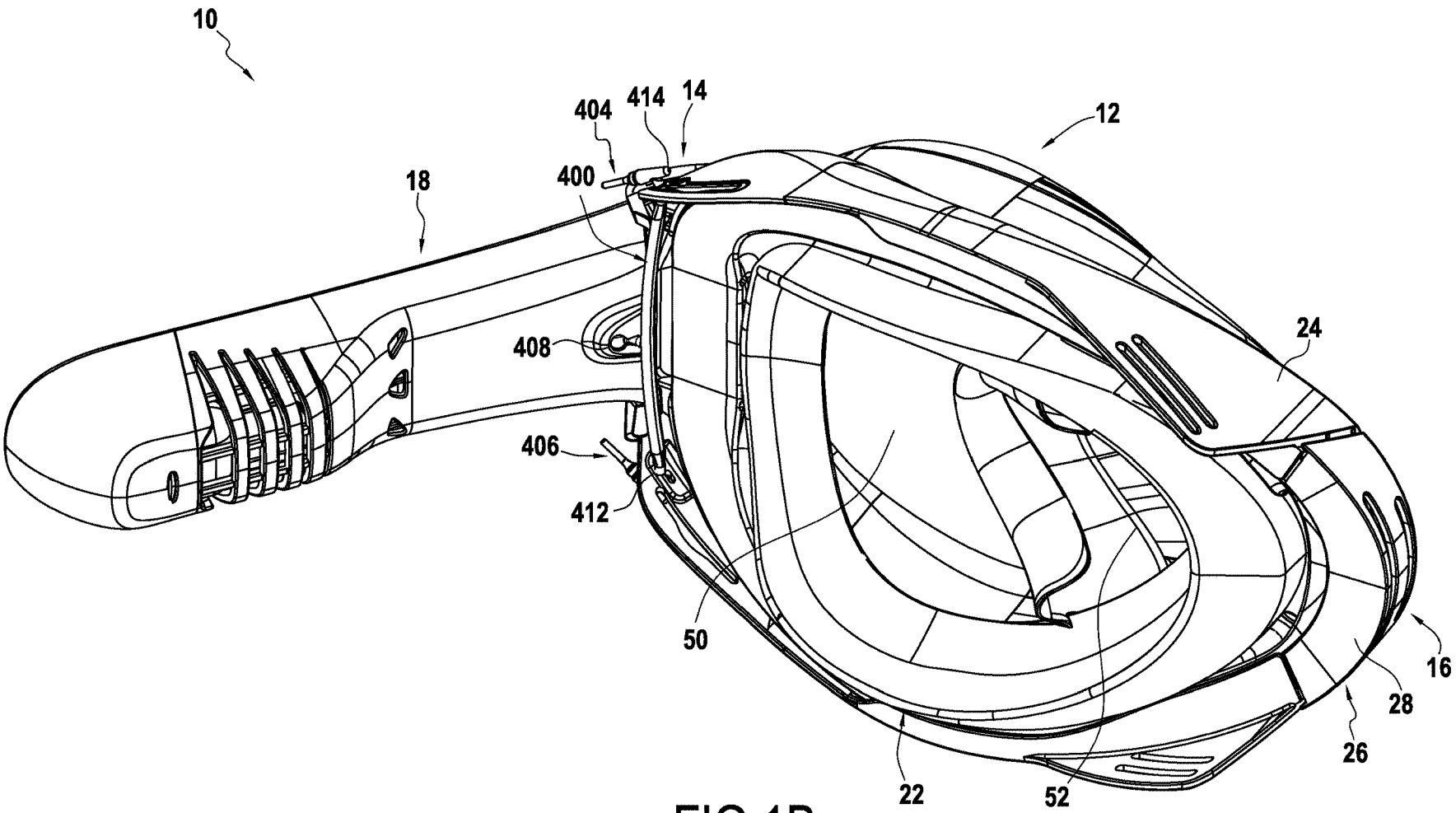
FIG. 1B is a rear view of the FIG. 1A mask.

FIGS. 1A and 1B show a diving mask 10 in accordance with the present disclosure.

The diving mask comprises a body 12 for placing over the face of a user, with the body 12 presenting a top portion 14 and a bottom portion 16.

From FIGS. 1A and 1B, it can be understood that the top portion 14 of the body 12 is for placing in the proximity of the user's forehead, whereas the bottom portion 16 of the body is for placing in the proximity of the user's chin.

Furthermore, the diving mask 10 includes a snorkel 18 that extends the top portion 14 of the body 12.

In this example, the snorkel 18 is mounted on the body 12 in removable manner.

Figure 2:
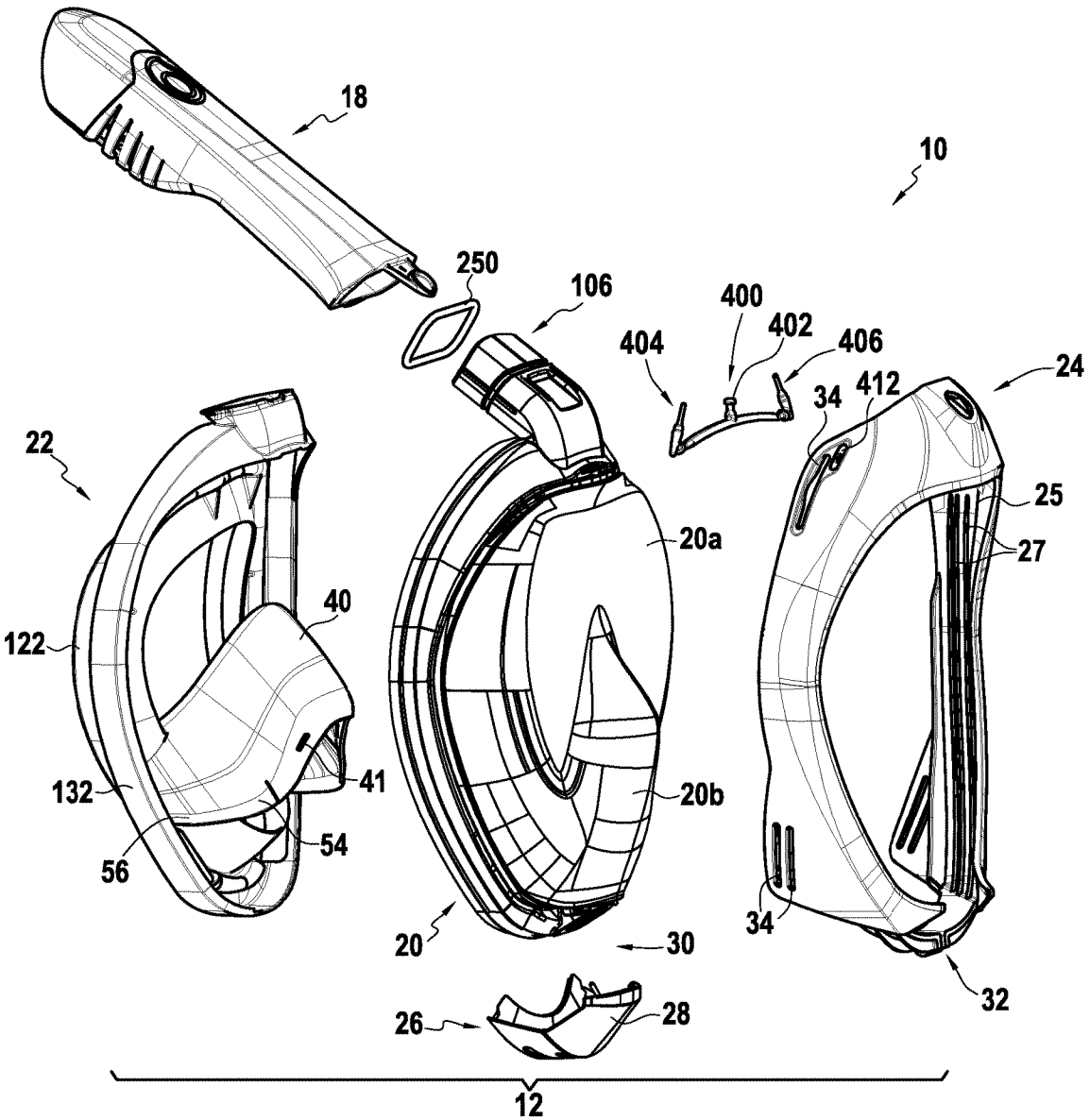
FIG. 2 is an exploded view of the FIG. 1 mask.

With reference to the exploded view of FIG. 2, it can be understood that the body 12 is constituted mainly by a faceplate 20 and a flexible skirt 22.

The faceplate 20 is made of rigid material, e.g. of polycarbonate, while the flexible skirt 22 is made of flexible material, e.g. of silicone obtained by injecting liquid silicone rubber (LSR).

The flexible skirt 22 is fastened to the faceplate.

The body 12 also has a band 24 that is shaped to surround the face. The particular function of the band 24 is to fasten the flexible skirt of the faceplate 20, or at least to improve such fastening.

The body 12 also has a chinpiece 26 comprising a cover 28 that covers a bottom portion 30 of the faceplate together with a bottom portion 32 of the band 24. As can be seen in FIG. 2, the bottom portion 32 of the band 24 is split and includes a clamping element enabling the band 24 to be clamped against the skirt and the faceplate.

As can be seen in FIGS. 1A and 1B, the band 24 also has slots 34 for receiving one or more elastic straps (not shown).

As can be seen in FIG. 2, the band 24 presents ridges 27 on its inside face 25 for the purpose of preventing the skirt from moving relative to the band.

Figure 3:
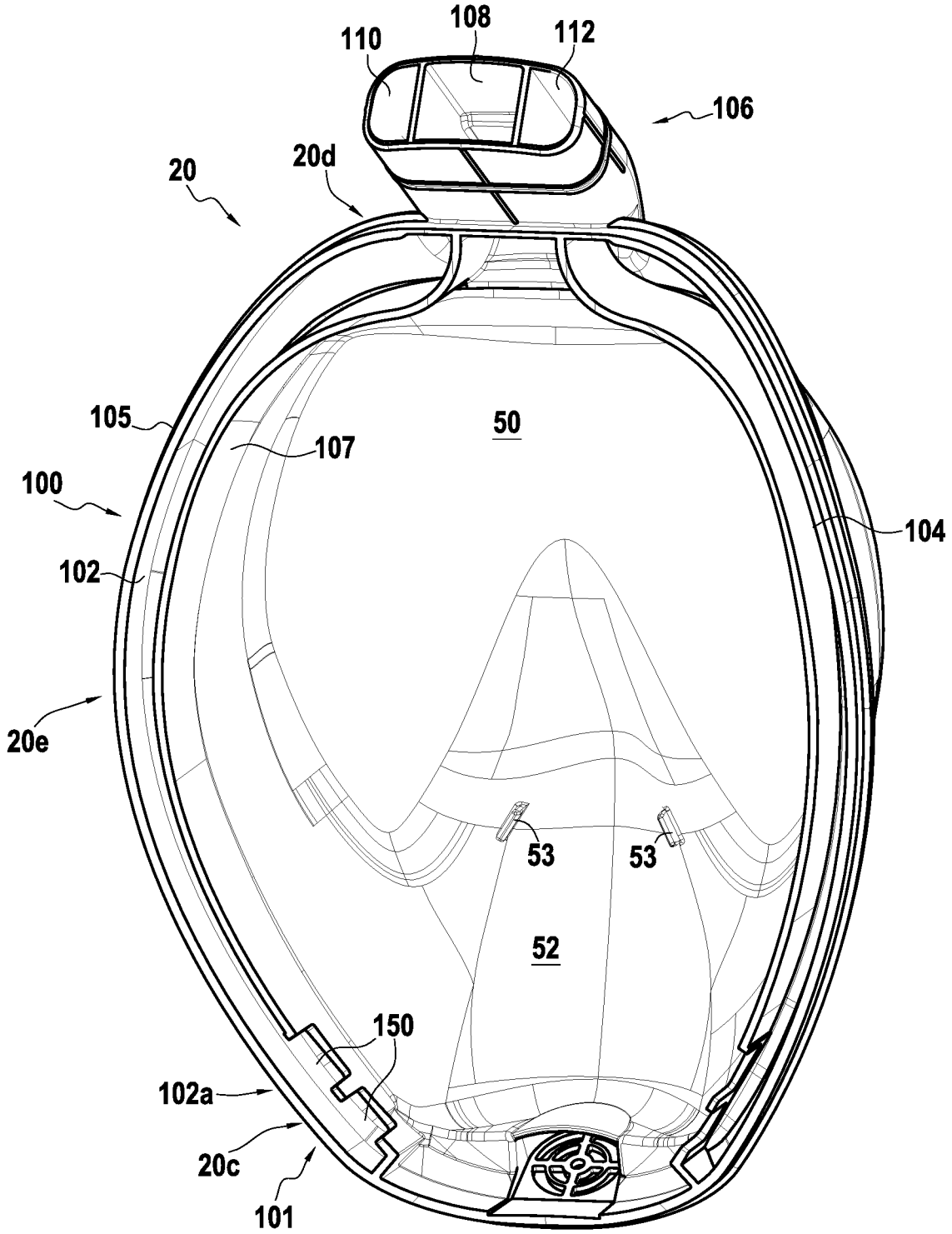
FIG. 3 is a rear view of the faceplate of the FIG. 1 mask.

With reference to FIGS. 1A and 3, it can be seen that the faceplate 20 is shaped to cover the user's face. The faceplate has a transparent plane portion 20*a* that is to be situated substantially level with the user's eyes, and a rounded portion 20*b* that is to be situated level with the user's nose and mouth. In this non-limiting example, the rounded portion 20*b* is transparent. Nevertheless, and without going beyond the ambit of the present disclosure, the rounded portion 20*b* could be opaque or it could be transparent and covered by an opaque cover.

With reference to FIGS. 1A, 1B, and 2, it can be seen that the flexible skirt 22 has a partition 40 separating a top chamber 50 for vision from a bottom chamber 52 for breathing, the partition 40 being arranged to bear on top of the user's nose so that the user's mouth and nose are situated in the bottom chamber 52, while the user's eyes are situated in the top chamber 50.

The partition 40 is fastened to the faceplate 20 by a fastener fitting that is clipped on fastener lugs 53 (visible in FIG. 3) that project from the inside face of the rounded portion 20*b*.

The partition includes two orifices 41 that engage with the fastener lugs 53 prior to positioning the fastener fitting.

The partition also has two passages 54 (more clearly visible in FIGS. 2 and 13) that are arranged to allow fresh air to flow between the top chamber 50 and the bottom chamber 52 while the user is breathing in.

Furthermore, in this example, the partition has two check valves 56 that are arranged to allow fresh air to flow from the top chamber 50 towards the bottom chamber 52 only during a stage in which the user is breathing in.

It can thus be understood that the check valves 56 serve to close the above-mentioned passages 54 during a stage while the user is breathing out.

Figure 13:
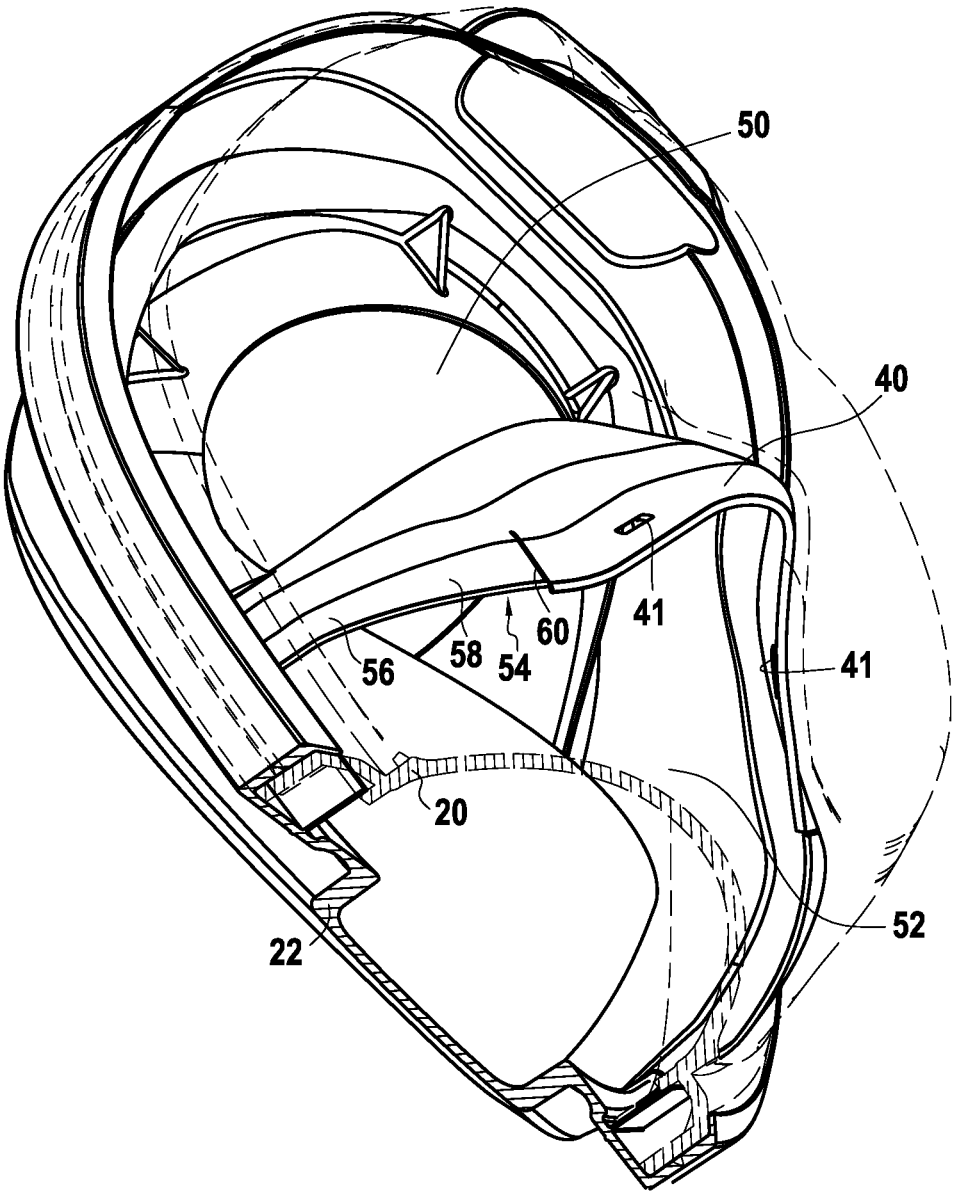
FIG. 13 is a view of the flexible skirt showing the check valve.

In this example, and as shown in FIG. 13, each of the check valves 56 comprises a membrane 58 constituted by a portion of the flexible skirt. More specifically, in this example, each membrane 58 is constituted by a portion of the partition 40 of the flexible skirt.

The membranes 58 are movable because the partition includes two cutouts 60 that enable each membrane to become detached locally from the remainder of the partition. These cutouts allow the membranes 58 to fold and to separate from the inside face of the faceplate, in particular during a stage of breathing in, so as to open the passages, thereby allowing fresh air to enter into the bottom chamber.

Operation is as follows.

During a stage of breathing out, the exhaled air has the effect of pressing the membranes 58 against the inside face of the rounded portion 20*b* of the faceplate, thereby having the effect of closing the passages 54 and thus of preventing the exhaled air from passing from the bottom chamber 52 to the top chamber 50.

During a stage of breathing in, the pressure drop that takes place in the bottom chamber 52 has the effect of separating the membranes 58 from the faceplate 20 and of opening the passages 54, thereby allowing fresh air to flow from the snorkel to the bottom chamber 52, passing via the top chamber 50.

Figure 7:
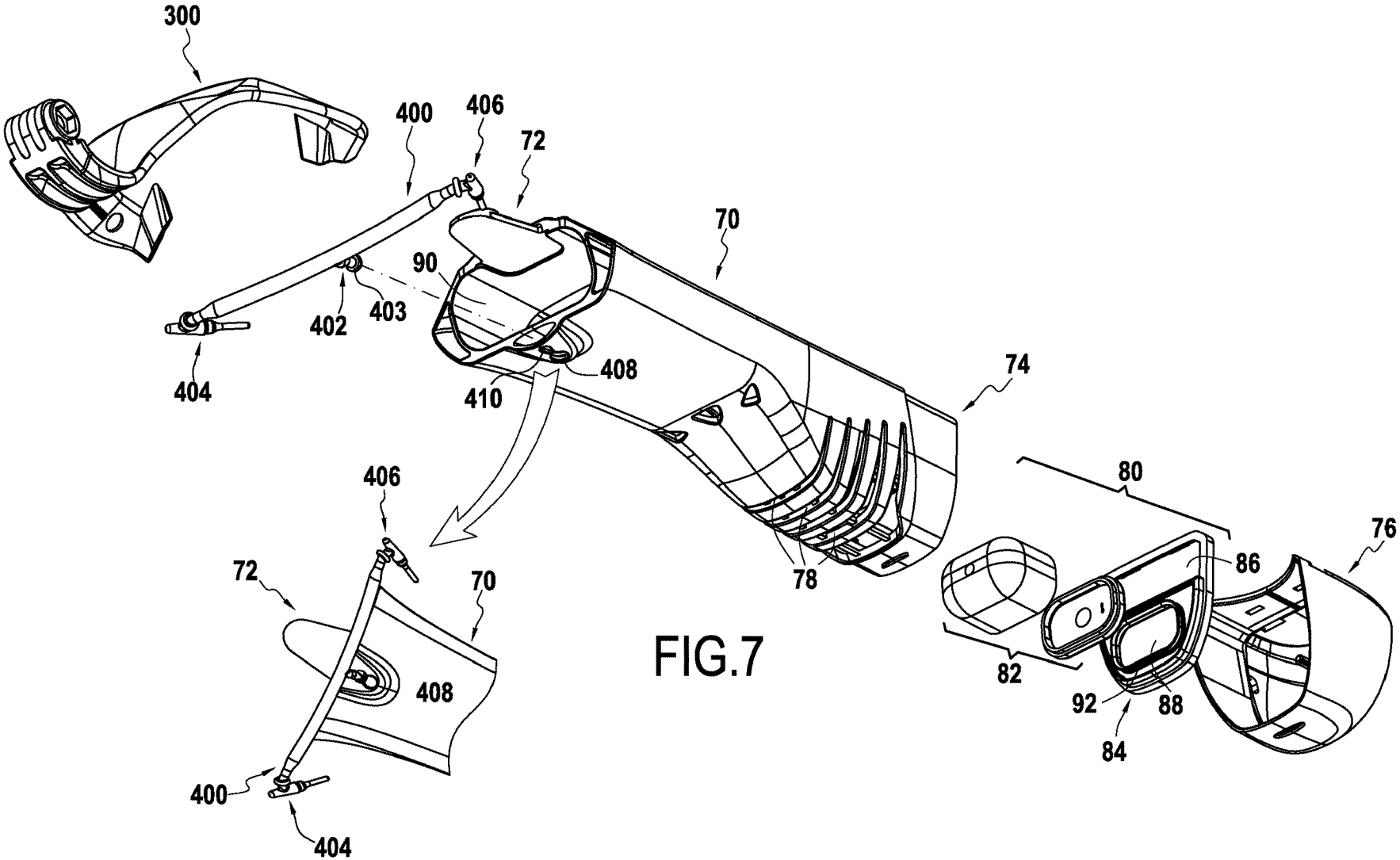
FIG. 7 is an exploded view of the snorkel of the FIG. 1 mask.

With reference to FIG. 7, it can be seen that the snorkel 18 comprises a tubular portion 70 having a first end 72 and a second end 74 remote from the first end 72.

The snorkel 18 also has a cover 76 that is mounted on the second end 74 of the tubular portion 70.

The tubular portion 70 also has holes 78 for allowing air to be exchanged between the atmosphere and the mask.

The snorkel 18 also has a device 80 for closing off the air inlet of the snorkel 18 when it is underwater. The device 80 comprises a float 82 that is movable in translation relative to a plate 84 that has a first orifice 86 and a second orifice 88, the first and second orifices 84 and 86 leading into an inside volume of the cover 76.

The first orifice 86 is in fluid-flow communication with an air duct 90 formed in the tubular portion 70 of the snorkel 18, while the second orifice 88 faces the float 82.

The second orifice 88 is surrounded by a sealing gasket 92 that is shaped to co-operate with the float 82 when the snorkel 18 is underwater.

Operation is as follows.

When the snorkel 18 is out of the water, the float 82 is in a low position, such that air can flow between the air duct 90 and the atmosphere via the holes 78 by passing successively via the first orifice 86, the chamber defined by the inside of the cover 76, and the second orifice 88.

When the snorkel 18 is underwater, the float 82 rises so as to become pressed against the gasket 92, thereby having the effect of closing the second orifice 88 and consequently air can no longer enter into the air duct 90.

Furthermore, in this example, the tubular portion has a single air duct 90 that communicates with the bottom and top chambers.

In accordance with the disclosure, the body 12 also has a device 100 for exhausting exhaled air that puts the bottom chamber 52 into fluid-flow communication with the air duct 90 of the snorkel 18.

It can thus be understood that during a stage of breathing out, the air exhaled into the bottom chamber 52 flows into the exhaled air exhaust device and then into the air duct 90 of the snorkel 18 prior to leaving the snorkel via the holes 78.

With reference to FIG. 3, the exhaled air exhaust device 100 has a first exhaled air exhaust channel 102 that extends along a first side edge 104 of the faceplate.

As can be seen in FIG. 3, the first exhaled air exhaust channel 102 extends between a bottom portion 20*c* of the faceplate 20 and a top portion 20*d* of the faceplate.

In this example, the first exhaled air channel 102 is constituted by two adjacent flanges 105, 107 that project from a first side edge 20*e* of the faceplate.

In this example, the first exhaled exhaust channel 102 is made integrally with the faceplate 20.

The exhaled air exhaust device 100 also includes a second exhaled air exhaust channel 104 that is similar to the first exhaled air exhaust channel 102 and that extends likewise between the bottom portion 20*c* of the faceplate and the top portion 20*d* of the faceplate.

Since the second exhaled air exhaust channel is similar to the first exhaled air exhaust channel, only the first exhaled air exhaust channel is described below.

The top portion 20*d* of the faceplate further includes a top connector 106 that is made integrally with the remainder of the faceplate and that includes a central duct 108, a first side duct 110, and a second side duct 112.

The central duct 108 is in fluid-flow communication with the top chamber 50, while the first side duct 110 is in fluid-flow communication with the first exhaled air exhaust channel 102, and the second side duct 112 is in fluid-flow communication with the second exhaled air exhaust channel 104.

As can be understood from FIG. 3, the first exhaled air exhaust channel 102 and the second exhaled air exhaust channel 104 lead to the bottom chamber 52.

Figure 8:
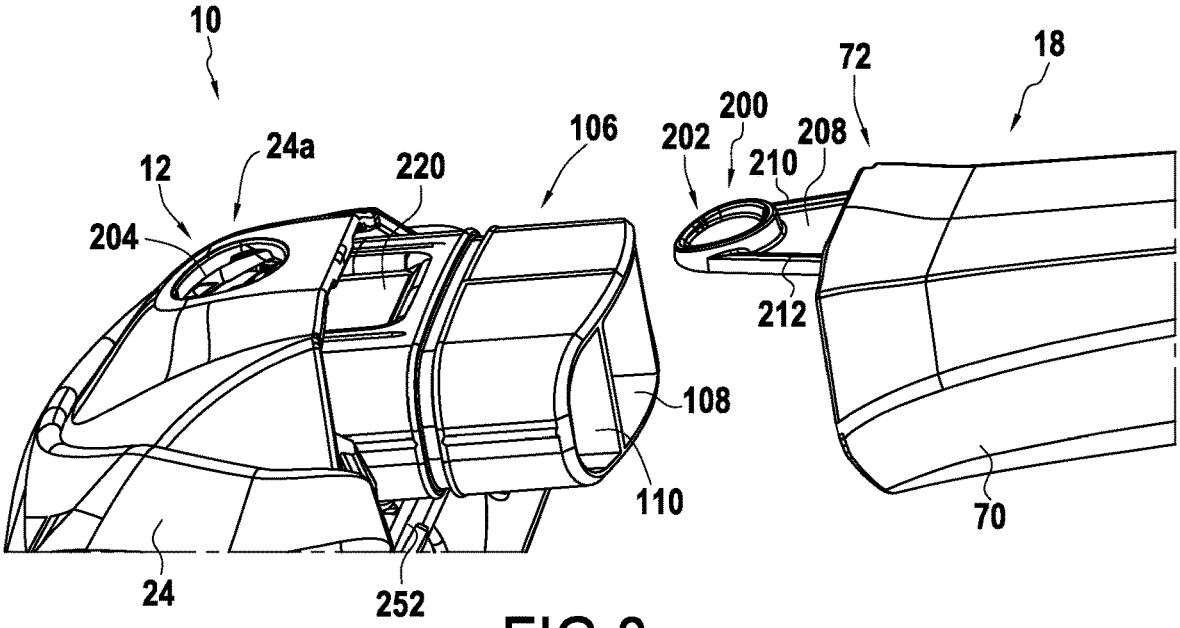
FIG. 8 shows the bottom end of the snorkel detached from the body of the FIG. 1 mask.
Figure 9:
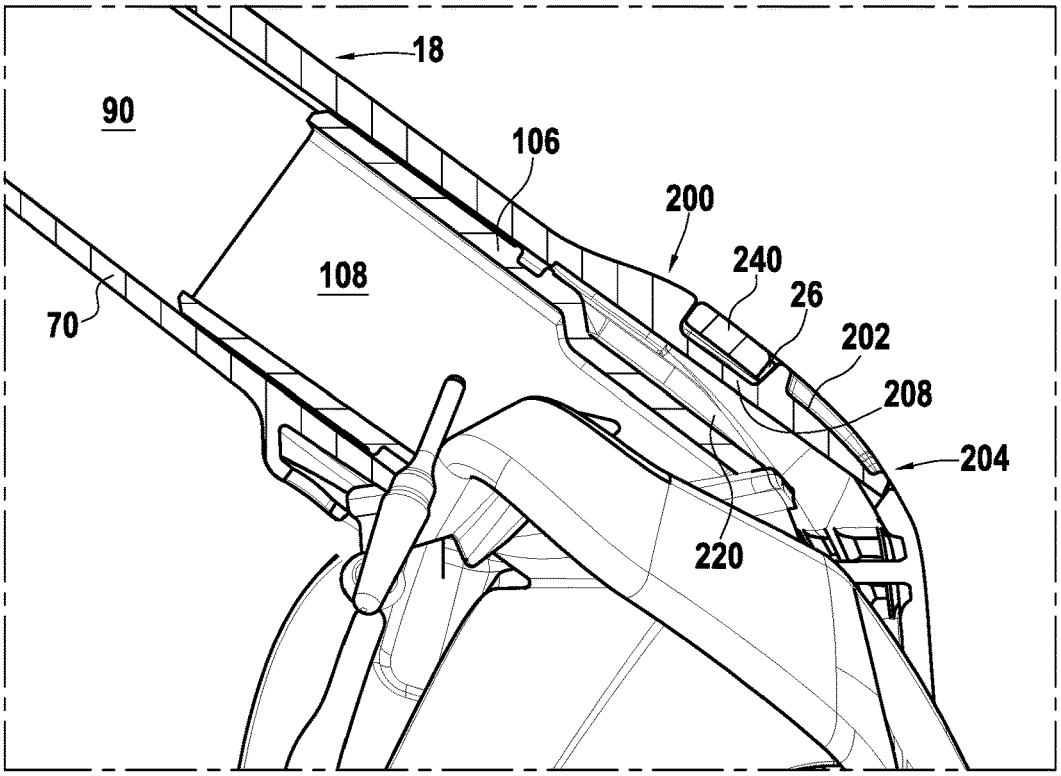
FIG. 9 is a section view showing the connection between the support and the body of the FIG. 1 mask.

As can be understood from FIGS. 8 and 9, the first end 72 of the tubular portion 70 of the snorkel 18 is shaped to be coupled with the top connector 106 of the faceplate.

Consequently, it can be understood that the central duct 108, and also the first and second side ducts 110 and 112 open out into the single air duct 90 of the snorkel.

Figure 4:
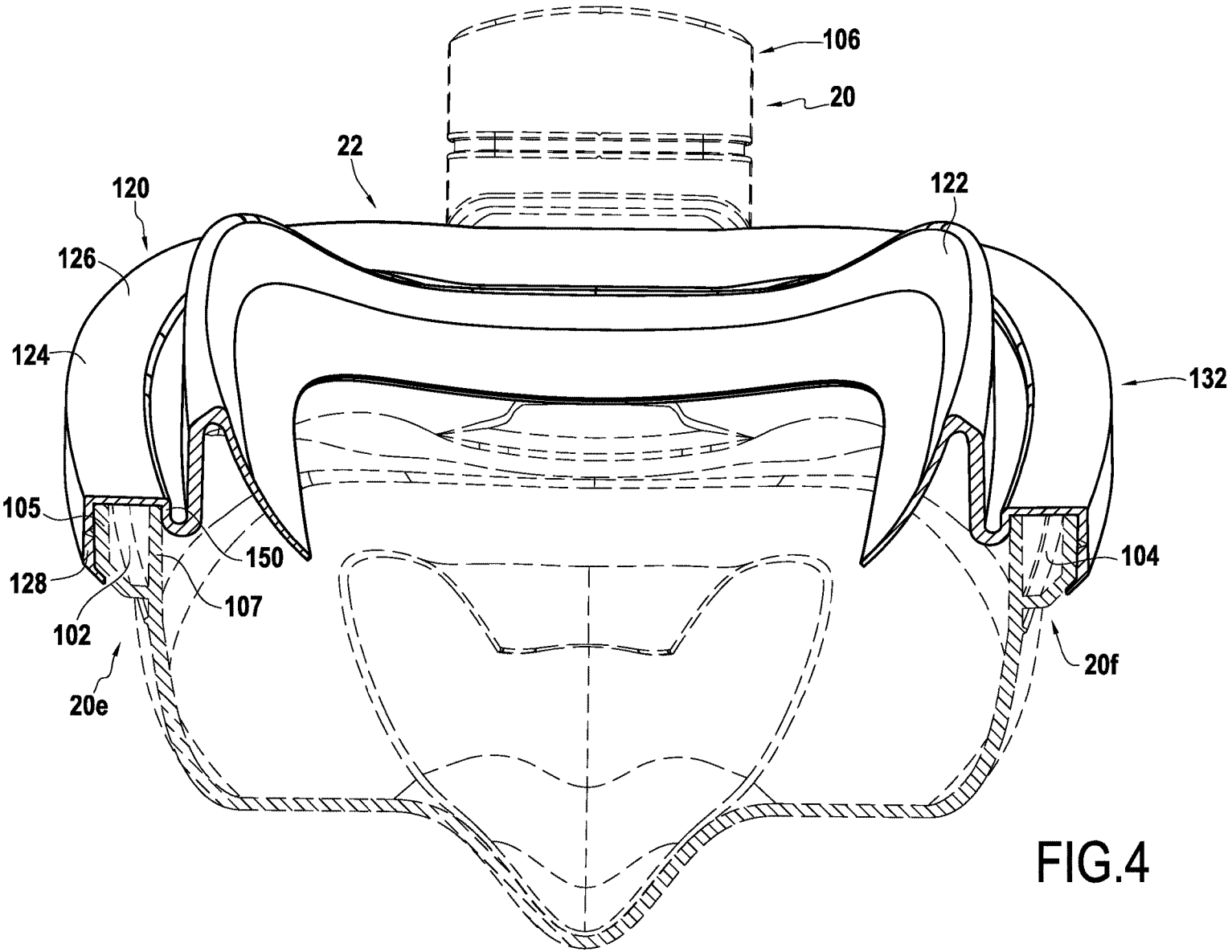
FIG. 4 is a section view on a transverse plane showing the coupling between the flexible skirt and the faceplate.

With reference to FIG. 4, there follows a description of how the flexible skirt 22 is fastened to the faceplate 20.

As can be understood from FIGS. 1B, 2, and 4, the flexible skirt 22 has a peripheral edge 120 that surrounds a sealing lip 122.

The sealing lip 122 is shaped to bear against the user's face so as to prevent water penetrating into the mask.

The peripheral edge 120 has a first side portion 124 that covers the first exhaled air exhaust channel 102, as can be understood from FIG. 4.

The peripheral edge of the skirt has a first side portion in which there is engaged the first exhaust channel so as to prevent water from penetrating into said first exhaled air exhaust channel.

For this purpose, the first side portion of the peripheral edge of the skirt 20 has a top wall 126 and two side walls 128, 130. It can be understood that the top wall and the two side walls are made integrally with the skirt.

The side walls 128 and 130 encompass the two flanges 105, 107 of the first exhaled air exhaust channel, while the top wall covers the first exhaled air exhaust channel so as to provide sealing.

Preferably, one of the flanges has a longitudinally projecting portion that co-operates with one or the other of the side walls of the peripheral edge of the skirt so as to ensure that the peripheral edge remains properly in place relative to the first exhaled air exhaust channel.

The peripheral edge of the flexible skirt 22 also includes a second side portion 130 that covers the second exhaled air exhaust channel 104.

In accordance with the disclosure, the exhaled air exhaust device 100 has a first check valve 140 that is arranged to allow exhaled air directed from the bottom chamber 52 to flow towards the air duct 90 of the snorkel during a stage in which the user is breathing out.

It can thus be understood that during a stage of breathing out, the flexible flap 58 of the partition 40 closes, while the first check valve 140 of the exhaled air exhaust device opens to allow the exhaled air to flow from the bottom chamber 52 to the exhaled air exhaust device 100, and more particularly towards the first exhaled air exhaust channel 102 and then towards the air duct 90 of the snorkel so as subsequently to be discharged via the holes 78.

Furthermore, the first check valve 140 is closed during a stage in which the user is breathing in. As a result, the user does not breathe in the air previously exhaled that is contained in the snorkel or in the exhaled air exhaust device while breathing in.

Figure 5:
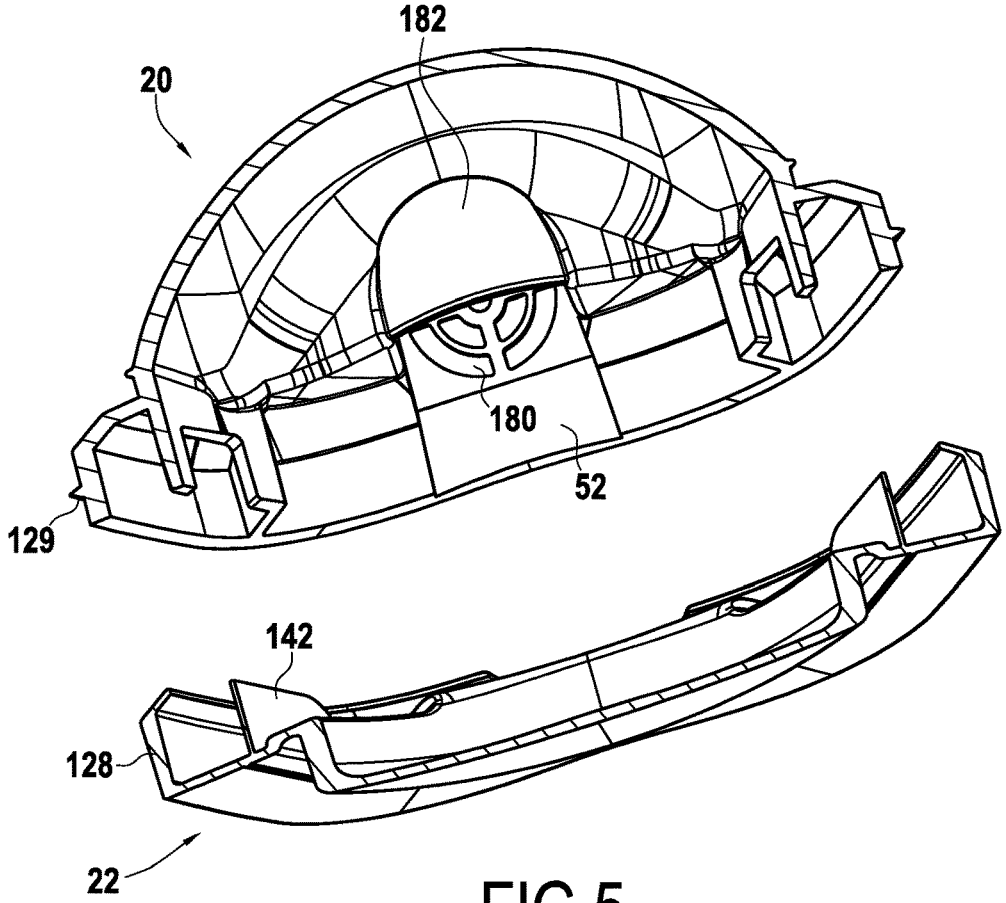
FIG. 5 is an exploded view in section of the bottom portion of the body of the mask, showing the first and second check valves.
Figure 6:
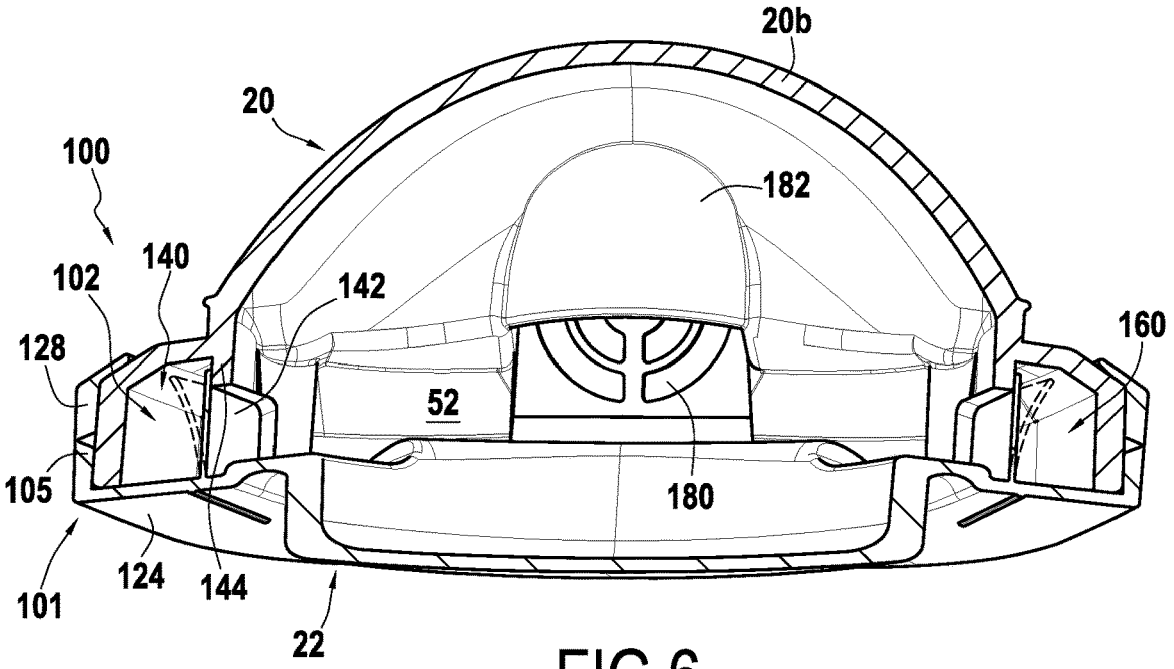
FIG. 6 shows the bottom portion of FIG. 5 once the flexible skirt and the faceplate have been assembled together.

As can be seen in FIGS. 5 and 6, the first check valve 140 is arranged in a bottom end portion 101 of the exhaled air exhaust device. More exactly, the first check valve 140 is arranged in a bottom end portion 102*a* of the first exhaled air exhaust channel.

In this example, the first check valve 140 is arranged between the bottom chamber 50 and the exhaled air exhaust device 100. More precisely, the first check valve 140 is arranged between the bottom chamber 52 and the first exhaled air exhaust channel 102.

Without going beyond the ambit of the present disclosure, the first check valve 140 could be arranged in the bottom chamber 52.

In an advantageous aspect of the disclosure, the first check valve 140 includes a flexible membrane 142 that is constituted by a portion of the flexible skirt 22 in this example.

The flexible membrane is in the form of a substantially rectangular portion that projects from an inside face of the top wall 126.

FIG. 6 shows the first check valve in the closed position in continuous lines. It also shows it in the open position in dashed lines.

The first check valve 140 also has a valve seat 144 arranged to co-operate with the flexible membrane 142, the valve seat 144 being integral with the faceplate. In the closed position, the flexible membrane bears against the valve seat in order to close the openings.

From FIGS. 3, 5, and 6, it can be seen that the first exhaled air exhaust channel 102 in this example includes two openings 150 that open out into the bottom chamber 52.

It can be seen that these two openings are arranged in the inner flange 107 of the exhaled air exhaust device 100.

The flexible membrane 142 is shaped to close both openings 150 during the stage in which the user is breathing in.

It can thus be understood that the flexible membrane 142 is situated inside the first exhaled air exhaust channel 102 in register with the two openings 150.

As explained above, the exhaled air exhaust device 100 also has a second exhaled air exhaust channel 104.

The exhaled air exhaust device 100 also has a second check valve 160 similar to the first check valve 140 and arranged to allow exhaled air coming from the bottom chamber 52 to flow towards the air duct 90 of the snorkel during a stage in which the user is breathing out.

The second check valve 160 is closed during a stage in which the user is breathing in.

In other words, the second check valve 160 operates like the first check valve 140.

Still with reference to FIGS. 5 and 6, it can be seen that the faceplate also includes a purge valve 180 that is arranged in a bottom end portion of the faceplate 20.

This purge valve 180 is covered in part by a protective plate 182, which in this example is formed integrally with the faceplate 20. The function of this protective plate is to prevent the purge valve 180 being damaged.

With reference to FIGS. 7, 8, and 9, it can be seen that the mask includes a system for releasably locking the snorkel to the body. In this example, the locking system comprises a tongue 200 that extends from the first end 72 of the tubular portion 70.

The tongue 200 is also provided with a fastener portion 202.

The band 24 also includes a top 24*a* having an opening 204 formed therein. This opening 204 is a through opening.

The fastener portion 202 of the tongue 200 is shaped to be received in the opening 204 in order to lock the snorkel to the body.

From FIGS. 8 and 9, it can be understood that the tongue is deformable, so that when engaging the snorkel 18 with the body 12, the top connector 106 engages in the air channel 90 of the snorkel 18 and the fastener portion 202 engages in the top portion of the band 24 and the top connector, until the fastener portion becomes engaged in the opening 204.

It can thus be understood that when the snorkel is mounted on the body, at least a portion of the tongue is arranged below the band. In other words, the tongue engages via the underside of the band. As can be seen in FIG. 9, the tongue is engaged between the top connector 106 and the band.

Furthermore, the fastener portion 202 also constitutes a pushbutton arranged to enable a user to disengage the fastener portion from the opening so as to separate the snorkel from the body.

For this purpose, the user presses on the fastener portion so as to deform the tongue, while also pulling on the snorkel in order to cause the fastener portion to pass under the band. The fastener portion 202 is constituted by a swelling 206 that presents a chamfered shape suitable for becoming engaged in the opening when the snorkel is mounted on the body.

In this example, the swelling is annular in shape.

Furthermore, the tongue 200 presents a reception portion 208 that is arranged between the fastener portion 202 and the tubular portion 70 of the snorkel. The reception portion is shaped to receive a portion 24*b* of the band 24 that forms an abutment when the snorkel is mounted on the body.

Furthermore, the reception portion 208 and the abutment-forming portion of the band 24 are engaged with each other by co-operating shapes when the snorkel is mounted on the body, thereby having the effect of preventing untimely unlocking of the snorkel.

Figure 10:
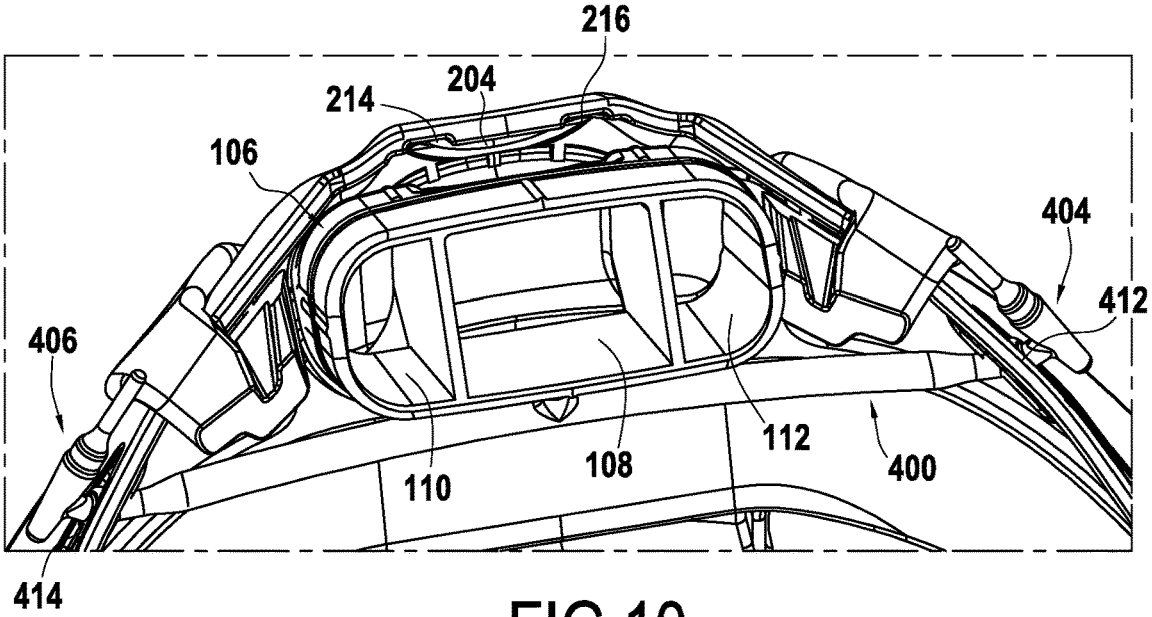
FIG. 10 is a detail view of the connector at the top of the faceplate.

Furthermore, the reception portion 208 has two ridges 210, 212 arranged on either side of said reception portion 208, these ridges extending between the first end of the tubular portion and the fastener portion, and co-operating with two grooves 214, 216 (visible in FIG. 10) in the band when the snorkel is mounted on the body. The advantage is to ensure that the snorkel is stable when it is mounted on the body.

Furthermore, the top connector 106 has a setback 220 that is situated under the fastener portion when the snorkel is mounted on the body. This setback receives the deformed tongue while the snorkel is being engaged on the body. It also serves to leave space for deforming the tongue while disengaging the snorkel from the body.

Finally, it can be seen that the mask also has a sealing gasket 250 arranged between the body and the snorkel. This sealing gasket 250 is received in an annular groove 252 arranged in the top connector of the faceplate.

Figure 11:
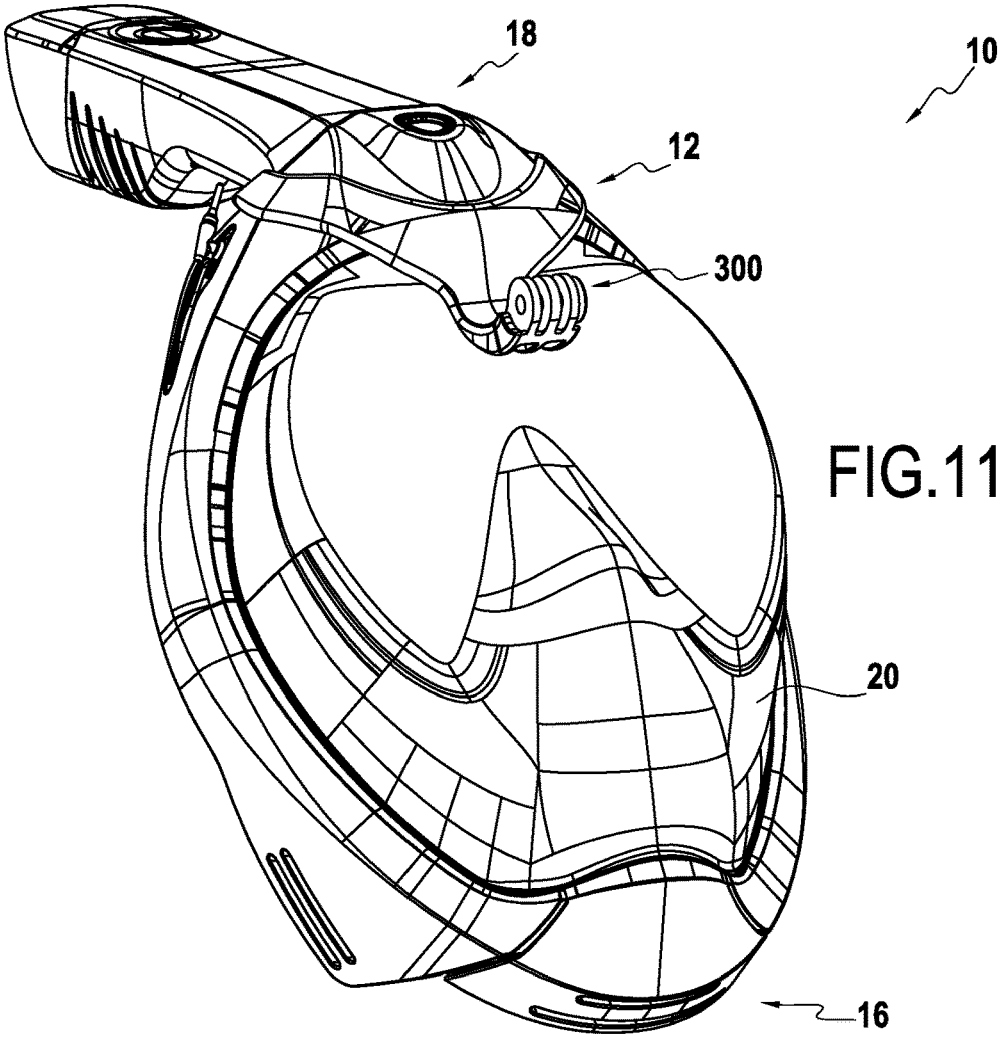
FIG. 11 shows the FIG. 1 mask fitted with a camera support.
Figure 12:
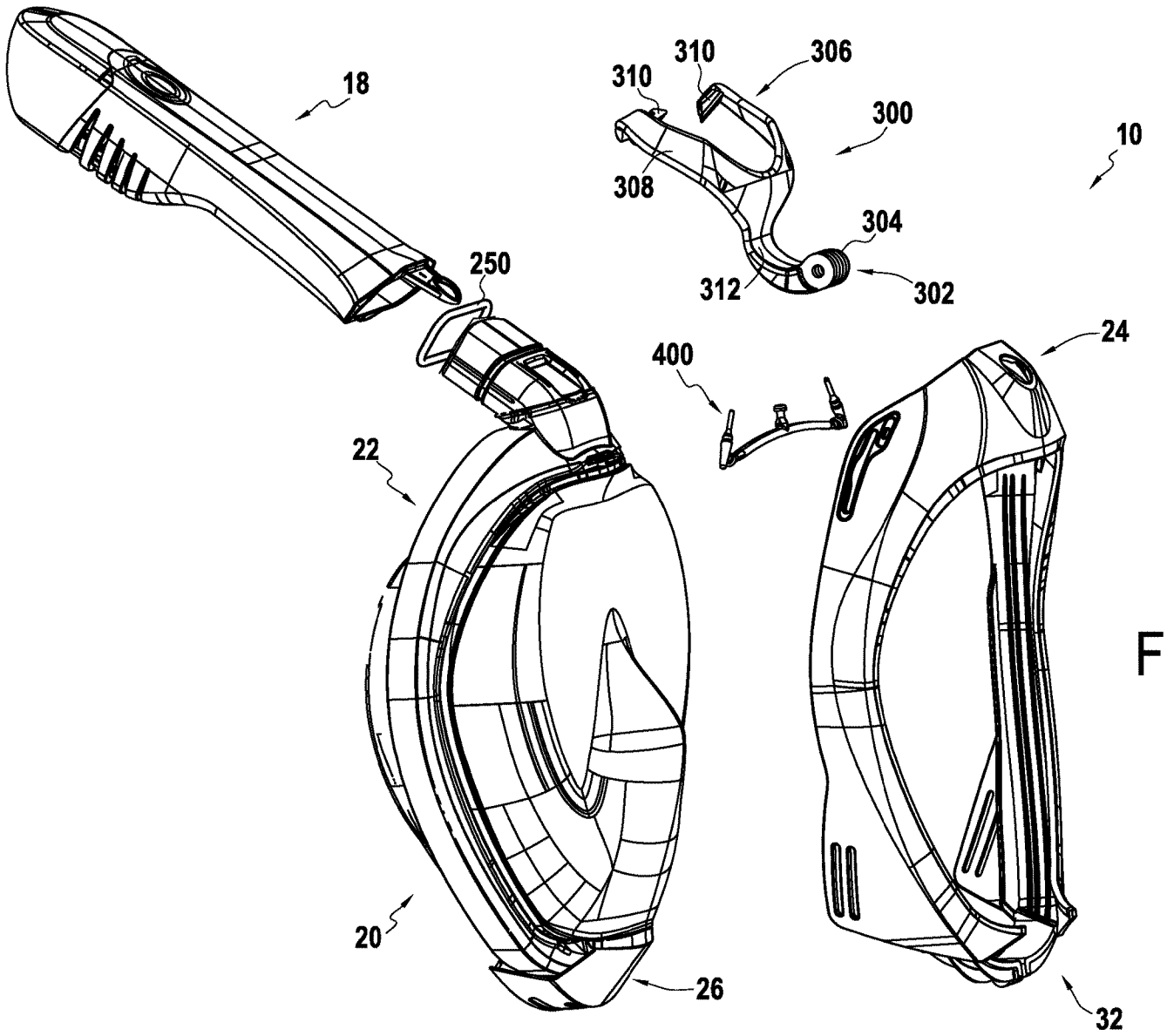
FIG. 12 is an exploded view of FIG. 11.

With reference to FIGS. 11 and 12, there follows a description of a support for fastening an accessory, e.g. a camera. This fastener support is preferably removable.

The fastener support 300 has a mounting portion proper 302 that presents a cylindrical fastener member 304 for receiving a camera (in known manner). The fastener support 300 is releasably mounted on the body of the mask.

The fastener support 300 also has two arms 306 and 308 that are terminated in two tabs 310 that are shaped to co-operate with the band of the body so as to hold the fastener support relative to the body.

The fastener support 300 also has a connection portion 312 that extends between the arms 306, 308 and the fastener member 304. This connection portion is hook-shaped so as to bear against the faceplate when the support is mounted on the mask, so that the tabs and the connection portion prevent the fastener support from moving relative to the body. In addition, the hook shape is arranged in such a manner that the fastener member 304 is substantially level with the user's eyes. Because of this advantageous position, the camera is necessarily underwater when the body of the mask is underwater with the snorkel out of the water. One advantage is thus to ensure that the camera is filming under water and not the surface of the water.

The diving mask also has a holder device 400 (visible in FIGS. 1B, 2, and 7) that has a central attachment element 402 situated between two side attachment elements 404 and 406.

The central attachment element 402 is in the form of a mushroom having its head 403 shaped to be inserted in succession through a first hole 408 and then a second hole 410 beside the first hole, the holes being formed in the proximity of the first end of the tubular portion of the snorkel. As can be seen in FIG. 7, the first hole 408 presents a diameter greater than the diameter of the second hole 410. The head 403 of the central attachment element 402 presents a diameter that is smaller than the diameter of the first hole but greater than the diameter of the second hole. It can thus be understood that the central attachment element 402 is secured to the snorkel when its head is taken into the second hole 410.

As can be understood from FIGS. 1B and 2, the side attachment elements 404 and 406 are in the form of pins that are to be inserted in openings 412 and 414 arranged in the frame, preferably in the band, so as to secure the holder device relative to the body.

It can thus be understood that the holder device 400 serves to hold the snorkel to the body, even when the tubular portion of the snorkel is decoupled for fluid flow purposes from the top connector, so as to avoid losing the snorkel.

The retention device 400 is preferably made out of a flexible material of rubber type.

The invention claimed is:

1. A diving mask, comprising:

a body having a faceplate and a flexible skirt, said flexible skirt including a partition separating a top chamber for vision from a bottom chamber for breathing, the partition being arranged to bear on the nose of a user so that the mouth and nose of the user are situated in the bottom chamber while the eyes of the user are situated in the top chamber, the partition including at least one passage arranged to allow fresh air to flow between the top chamber and the bottom chamber during a stage in which the user is breathing in; and a snorkel arranged to extend from a top portion of the body, the snorkel including at least one air duct, wherein the body includes an exhaled air exhaust device putting the bottom chamber into fluid-flow connection with the air duct of the snorkel, and wherein the exhaled air exhaust device includes at least a first check valve arranged between the bottom chamber and the exhaled air exhaust device to allow exhaled air from the bottom chamber to flow towards the air duct of the snorkel during a stage in which the user is breathing out, the first check valve being closed during the stage in which the user is breathing in.

2. The diving mask according to claim 1, wherein the first check valve is arranged in the bottom chamber.

3. The diving mask according to claim 1, wherein the first check valve is arranged in a bottom end portion of the exhaled air exhaust device.

4. The diving mask according to claim 1, wherein the first check valve includes a flexible membrane.

5. The diving mask according to claim 4, wherein the flexible membrane is constituted by a portion of the flexible skirt.

6. The diving mask according to claim 4, wherein the first check valve includes a valve seat co-operating with the flexible membrane, the valve seat being integral with the faceplate.

7. The diving mask according to claim 4, wherein the exhaled air exhaust device includes at least a first exhaled air exhaust channel extending along one of the side edges of the faceplate, the flexible skirt having a first side portion that covers the first exhaled air exhaust channel, wherein the first exhaled air exhaust channel includes a bottom end portion having at least one opening opening out into the bottom chamber, wherein the first check valve is arranged to close said opening during the stage in which the user is breathing in, and wherein the flexible membrane is situated inside the first exhaled air exhaust channel, in register with said opening.

8. The diving mask according to claim 1, wherein the exhaled air exhaust device includes at least a first exhaled air exhaust channel extending along one of the side edges of the faceplate, the flexible skirt having a first side portion that covers the first exhaled air exhaust channel.

9. The diving mask according to claim 8, wherein the first exhaled air exhaust channel is integral with the faceplate.

10. The diving mask according to claim 8, wherein the first exhaled air exhaust channel includes a bottom end portion having at least one opening opening out into the bottom chamber, and wherein the first check valve is arranged to close said opening during the stage in which the user is breathing in.

11. The diving mask according to claim 8, wherein the exhaled air exhaust device further includes a second exhaled air exhaust channel and a second check valve arranged to allow exhaled air from the bottom chamber to flow towards the air duct of the snorkel during the stage in which the user is breathing out, the second check valve being closed during the stage in which the user is breathing in.

12. The diving mask according to claim 1, wherein the snorkel includes a single air duct that is in fluid-flow communication with the bottom chamber and with the top chamber.

13. The diving mask according to claim 1, wherein the partition includes at least one check valve arranged to allow fresh air from the top chamber to flow towards the bottom chamber only during the stage in which the user is breathing in.

14. The diving mask according to claim 13, wherein the check valve includes a flexible flap constituted by a portion of the flexible skirt.

15. A diving mask, comprising:

a body having a faceplate and a flexible skirt, said flexible skirt including a partition separating a top chamber for vision from a bottom chamber for breathing, the partition being arranged to bear on the nose of a user so that the mouth and nose of the user are situated in the bottom chamber while the eyes of the user are situated in the top chamber, the partition including at least one passage arranged to allow fresh air to flow between the top chamber and the bottom chamber during a stage in which the user is breathing in; and a snorkel arranged to extend from a top portion of the body, the snorkel including at least one air duct, wherein the body includes an exhaled air exhaust device putting the bottom chamber into fluid-flow connection with the air duct of the snorkel, wherein the exhaled air exhaust device includes at least a first check valve arranged to allow exhaled air from the bottom chamber to flow towards the air duct of the snorkel during a stage in which the user is breathing out, the first check valve being closed during the stage in which the user is breathing in, and wherein the first check valve is arranged in the bottom chamber.

16. A diving mask, comprising:

a body having a faceplate and a flexible skirt, said flexible skirt including a partition separating a top chamber for vision from a bottom chamber for breathing, the partition being arranged to bear on the nose of a user so that the mouth and nose of the user are situated in the bottom chamber while the eyes of the user are situated in the top chamber, the partition including at least one passage arranged to allow fresh air to flow between the top chamber and the bottom chamber during a stage in which the user is breathing in; and a snorkel arranged to extend from a top portion of the body, the snorkel including at least one air duct, wherein the body includes an exhaled air exhaust device putting the bottom chamber into fluid-flow connection with the air duct of the snorkel, wherein the exhaled air exhaust device includes at least a first check valve arranged to allow exhaled air from the bottom chamber to flow towards the air duct of the snorkel during a stage in which the user is breathing out, the first check valve being closed during the stage in which the user is breathing in, and wherein the first check valve is arranged in a bottom end portion of the exhaled air exhaust device.

17. A diving mask, comprising:

a body having a faceplate and a flexible skirt, said flexible skirt including a partition separating a top chamber for vision from a bottom chamber for breathing, the partition being arranged to bear on the nose of a user so that the mouth and nose of the user are situated in the bottom chamber while the eyes of the user are situated in the top chamber, the partition including at least one passage arranged to allow fresh air to flow between the top chamber and the bottom chamber during a stage in which the user is breathing in; and a snorkel, distinct from the body, arranged to extend from a top portion of the body, the snorkel including at least one air duct, wherein the body includes an exhaled air exhaust device in fluid flow communication with the bottom chamber to evacuate the exhaled air out of the body, and wherein the body includes at least a first check valve arranged in the exhaled air exhaust device to allow exhaled air from the bottom chamber to flow through the exhaled air exhaust device during a stage in which the user is breathing out, the first check valve being closed during the stage in which the user is breathing in.

18. The diving mask according to claim 17, wherein the first check valve includes a flexible membrane.

19. The diving mask according to claim 18, wherein the first check valve includes a valve seat co-operating with the flexible membrane, the valve seat being integral with the faceplate.

20. The diving mask according to claim 17, wherein the exhaled air exhaust device includes at least a first exhaled air exhaust channel extending along one of the side edges of the faceplate, the flexible skirt having a first side portion that covers the first exhaled air exhaust channel.

21. The diving mask according to claim 20, wherein the first exhaled air exhaust channel is integral with the faceplate.

* * * * *